United States Patent [19]

Mather

[11] 4,022,459

[45] May 10, 1977

[54] ENVELOPE STACKER

[76] Inventor: Richard A. Mather, 59 Strawhat Road, Apt. 1-A, Owings Mills, Md. 21117

[22] Filed: Nov. 19, 1975

[21] Appl. No.: 633,590

Related U.S. Application Data

[63] Continuation of Ser. No. 491,312, July 24, 1974, abandoned.

[52] U.S. Cl. ..... 271/223; 271/217
[51] Int. Cl.[2] ..... B65H 31/20
[58] Field of Search ..... 271/147, 171, 217, 223, 271/224; 214/6 H, 6 S, 8

[56] References Cited

UNITED STATES PATENTS

| | | | |
|---|---|---|---|
| 1,395,897 | 11/1921 | Berkowitz | 271/171 |
| 1,700,990 | 2/1929 | Sullivan | 271/223 |
| 2,922,647 | 1/1960 | Buttner | 271/171 |
| 3,862,753 | 1/1975 | Giorgini | 271/171 |

*Primary Examiner*—Robert W. Saifer
*Attorney, Agent, or Firm*—J. Wesley Everett

[57] ABSTRACT

An envelope stacker capable of stacking envelopes as they are discharged from an automatic pile delivery printing press. The stacker having a plurality of adjustable vertical standards extending upwardly from a base member through appropriate slots in a movable table positioned upwardly from the base and supported on an elevator normally carried by the printing press.

1 Claim, 6 Drawing Figures

ENVELOPE STACKER

This is a continuation of application Ser. No. 491,312(A/U313) filed July 24, 1974 now abandoned.

The present invention relates to an apparatus for stacking envelopes after they are passed through a printing press.

Normally these printing presses are constructed to print and collect printed sheets of substantial size on a vertical movable platform pallett; however, printing envelopes which are of substantially smaller dimensions than the normal sheets creates a problem in that the envelopes spread around on the platform and are difficult to keep in an orderly stacked position.

One of the objects of the invention is to provide an envelope stacker of simple construction and one that is adjustable to different size envelopes.

Another object of the invention is to provide an envelope stacker that does not require any change in the printing press.

While several objects have been noted, other objects, uses and advantages, will become more apparent as the nature of the stacker is more fully disclosed in the following description with reference to the accompanying drawings; in the drawings.

Figure 1:
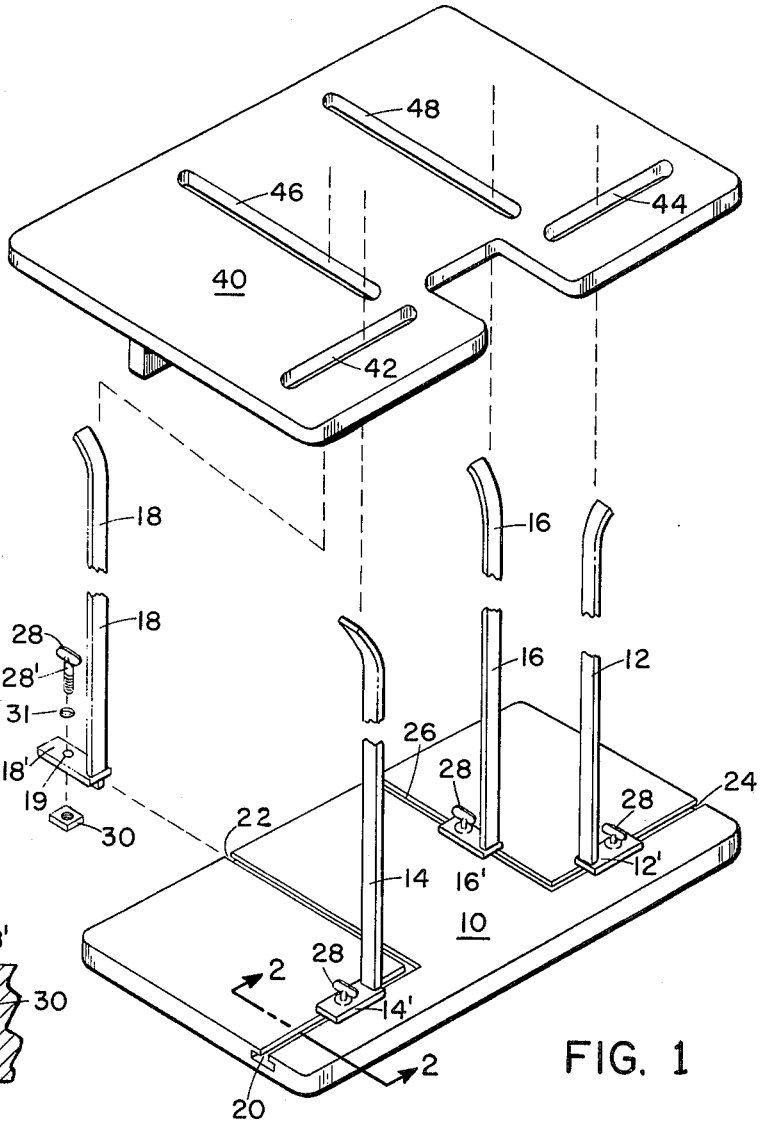
FIG. 1 is an exploded perspective view of the stacker having several of its parts detached to show specifically the construction of the same.
Figure 2:
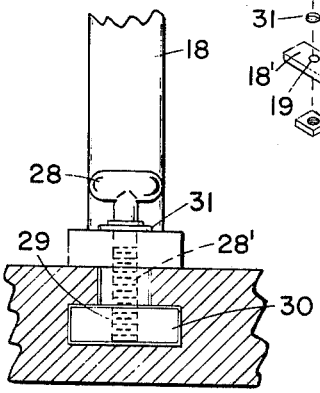
FIG. 2 is an enlarged fragmentary view of one of the parts of the stacker.
Figure 4:
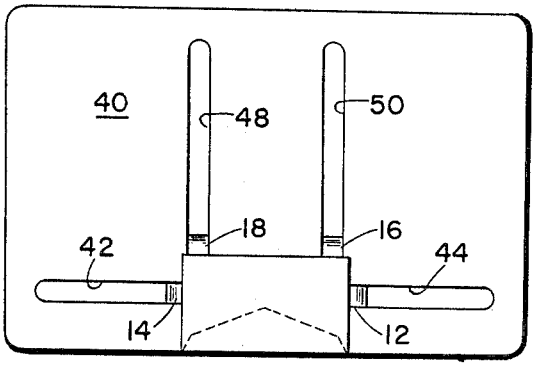
FIG. 4 is a top plan view of the stacker adjusted to stack small-sized envelopes.
Figure 5:
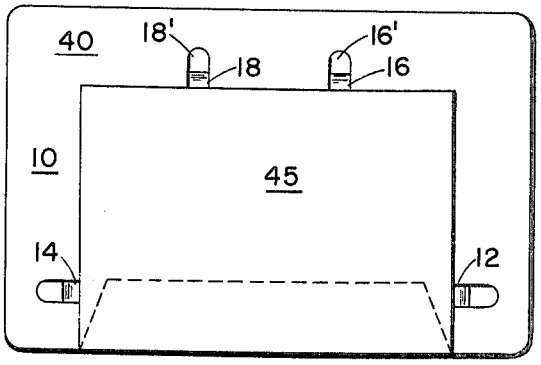
FIG. 5 is a top plan view of the stacker adjusted to stack large-sized envelopes.

Referring to the drawings, and in particular to FIG. 1, the stacker comprises a base 10, a pair of laterally adjustable standards 12 and 14 adapted to define the location of the end of the envelopes as they enter the stacking area and a pair of standards 16 and 18 adapted to be moved perpendicular to the plane of standards 12 and 14 for contacting at least one edge of the envelope positioned towards the printing press for guiding the longitudinal edge of the envelope.

These standards are movably secured to the base 10 by means normally in the form of the inverted T-shaped slots 20, 22, 24 and 26, and the securing means 28, 28′, 30 and 31. Each standard is provided with a foot formed at right angles to each of the standards as indicated by 12′, 14′, 16′ and 18′. Each of these foot members is provided with an aperture 19 through which the secured means is extended.

All standards are adjustably fixable within the inverted T-shaped slots by the thumb screws 28. The thumb screws 28 are provided with exterior threads 28′ which are threadably receivable into nuts 30, which when loosened will allow the standards to be moved along the slots and when screwed tight will hold the standards in fixed position. To provide more effective bearing for the outer end of the screws each screw is provided a washer 31.

Extending upwardly from the base 10 there is preferably a removable table 40 for receiving the envelopes. The table is provided with a plurality of slots 42, 44, 46, 48. These slots are to allow the upwardly extended standards 12 to 18 to extend through the table. The slots are elongated in order that the standards may be adjusted along the bayoneted slots in the base and at the same time extend through the slots in the table.

The table 40 is supported by members 52 and 54 which are part of the elevator normally carried and operated as part of the printing press.

Figure 3:
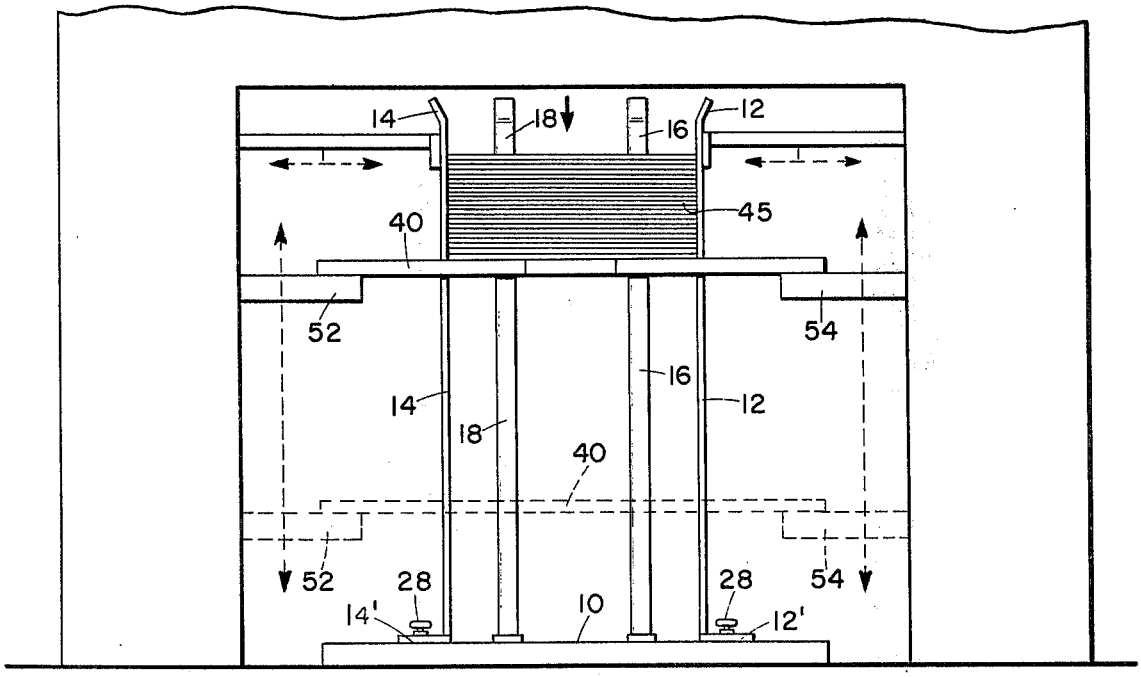
FIG. 3 is a vertical rear view of the stacker in a position adjacent the discharge end of a printing press.

FIG. 3 shows the stacker in position at the discharge end of the printing press after the stacker has been placed in position. The standard may be adjusted to the size of the envelope being printed and secured to the base member 10 and placed in its proper relationship to the press. The slotted table 40 is lowered over the upper end of the standards and rests on the elevator members 52 and 54 which are raised to the proper height.

When the printing press is operated, the elevator members 52 and 54 will drop a fraction of an inch of the thickness of the envelopes so that the envelopes deposited in the stacker land at substantially the same level on the stack.

If the elevator is moving too swiftly or too slowly, this may be taken care of by manually adjusting the height and/or speed of the elevator.

Figure 6:
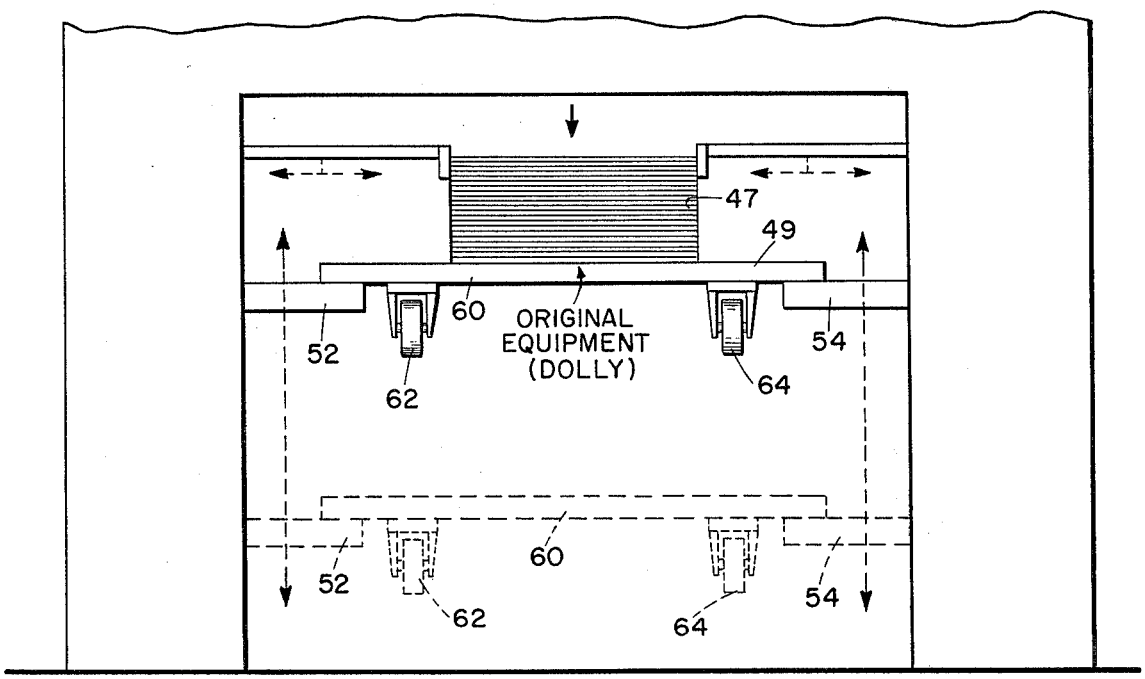
FIG. 6 is a view in elevation of the discharge end of the printing press, showing the manner in which printed sheets are collected.

In FIG. 6 the printing press is shown operating on a large sheet wherein the envelope stacker is not used and the table 40 is removed and a dolly 60 having casters 62 and 63, is substituted for the table.

While the invention is shown in a particular form, it is not intended to be a limitation as the scope of the invention is best defined in the appended claims.

I claim:

1. An envelope stacking unit removably attachable with a printing press, said printing press including an elevator for receiving printed envelopes discharged therefrom, and a base for supporting said printing press, said envelope stacking means comprising:

a. an independent unit comprising a base member of substantially rectangular form adapted to be positioned below the said elevator and in substantially the same plane as the base of the printing press, at least one pair of slots of an inverted T-shape in cross-section extending laterally of said base and at least one pair of slots of an inverted T-shape in cross-section extending perpendicular to the first-mentioned slots in the said base;

b. a single upright standard extending upwardly from each of the said inverted T-shaped slots, means extending upwardly from the upper surface of the base and engaging said slots for fixing the position of each standard in adjustable position along the slots relative to the said base;

c. the length of the standards being substantially that of the operating distance of the elevator;

d. a table for receiving the said envelopes having the same number of elongated apertures as the number of slots in the base for receiving the said standards, the openings in the table being of such dimensions as to allow free passage of the standards within the opening of the table, the width of the table being such as to engage means carried by the elevator for raising and lowering said table relative to the base when the table of the said envelope stacking unit is in position to engage the said elevator engaging means;

e. each of said standards having an L-shaped foot integral therewith of greater width than said slots and having bores therethrough, said feet resting on the base above said upper portion of said slots, nuts larger than the slots slidably disposed in the lower portion of the slots aligned beneath the apertures in the L-shaped feet, and threaded thumbscrews passing through the apertures in the feet, the slots and the nuts to quickly and easily adjust the standards to a desired position.

* * * * *